United States Patent [19]

Engel et al.

[11] 4,269,260

[45] May 26, 1981

[54] PROTECTION ARRANGEMENT FOR PREVENTING DAMAGE AT A CONTINUOUS CASTING PLANT FOR SLABS

[75] Inventors: Kurt Engel, Leonding; Werner Scheurecker, Linz, both of Austria

[73] Assignee: Voest-Alpine Aktiengesellschaft, Linz, Austria

[21] Appl. No.: 31,538

[22] Filed: Apr. 19, 1979

[30] Foreign Application Priority Data

May 3, 1978 [AT] Austria ..... 3198/78

[51] Int. Cl.[3] ..... B22D 11/128

[52] U.S. Cl. ..... 164/442; 49/404

[58] Field of Search ..... 164/436, 441, 442, 447, 164/448; 160/84 R; 49/404

[56] References Cited

U.S. PATENT DOCUMENTS

| | | | |
|---|---|---|---|
| 3,860,061 | 1/1975 | Hoyer | 164/442 X |
| 3,913,658 | 10/1975 | Schmid | 164/436 X |
| 3,926,242 | 12/1975 | Lowe | 160/84 R X |

FOREIGN PATENT DOCUMENTS

| | | | |
|---|---|---|---|
| 455796 | 2/1975 | U.S.S.R. | 164/447 |

*Primary Examiner*—Robert D. Baldwin

*Attorney, Agent, or Firm*—Brumbaugh, Graves, Donohue & Raymond

[57] ABSTRACT

A protection arrangement for preventing damage at a continuous casting plant for slabs in case of a breakthrough of molten metal through the solidified strand skin, includes a collecting device for molten metal provided below the mould at a supporting stand for the strand and enclosing the strand in the peripheral direction. The collection device is made up of displaceable collecting plates with separate collecting plates for each side of the strand. The collecting plates on the broad sides are each connected with part of the supporting stand, and the collecting plates provided for the narrow sides are displaceable by an adjusting device and overlap the collecting plates on the broad sides.

4 Claims, 4 Drawing Figures

PROTECTION ARRANGEMENT FOR PREVENTING DAMAGE AT A CONTINUOUS CASTING PLANT FOR SLABS

BACKGROUND OF THE INVENTION

The invention relates to a protection arrangement for preventing damage at a continuous casting plant for slabs, in case of a breakthrough of molten metal through the solidified strand skin, including a collecting device for liquid metal provided below the mould at a supporting stand for the strand. Such a collecting device encloses the strand in the peripheral direction and is made up of displaceable collecting plates that are adjustable to the strand skin.

A protection arrangement of this kind is already known in which the collecting device is designed as a two-part trough completely enclosing the slab strand. The two U-shaped parts of this trough are adjustable to the slab strand, encompass, like clamps, one half of the strand slab each, and are horizontally displaceable relative to each other. Such a trough is not suited for a plant in which slabs of different cross sectional dimensions are cast. If the format of the slab cross section is changed, also the parts of the trough have to be exchanged.

SUMMARY OF THE INVENTION

The invention aims at avoiding this difficulty and has as its object to provide a protection arrangement of the initially-defined kind which can be used universally for all formats of slab cross sections to be cast in a continuous casting plant for slabs, which formats may vary both with regard to their thickness and width.

This object is achieved according to the invention in that separate collecting plates are provided at the supporting stand for each side of the strand. The collecting plates at the broad sides are each connected with part of the supporting stand, and the collecting plates for the narrow sides are adjustable to the strand by an adjustment device and overlap the collecting plates at the broad sides.

According to a preferred embodiment, the collecting plate for each of the narrow sides includes two parts, the inner one being adapted to be retracted and extended relative to the outer one.

Advantageously, the collecting plate is connected with a run-off channel at part of the supporting stand, the collecting arrangement thus being applicable for any amount of liquid metal running off.

BRIEF DESCRIPTION OF THE DRAWINGS

The invention will now be explained in more detail by way of one embodiment and with reference to the accompanying drawings, wherein.

DESCRIPTION OF AN EXEMPLARY EMBODIMENT

Figure 1:
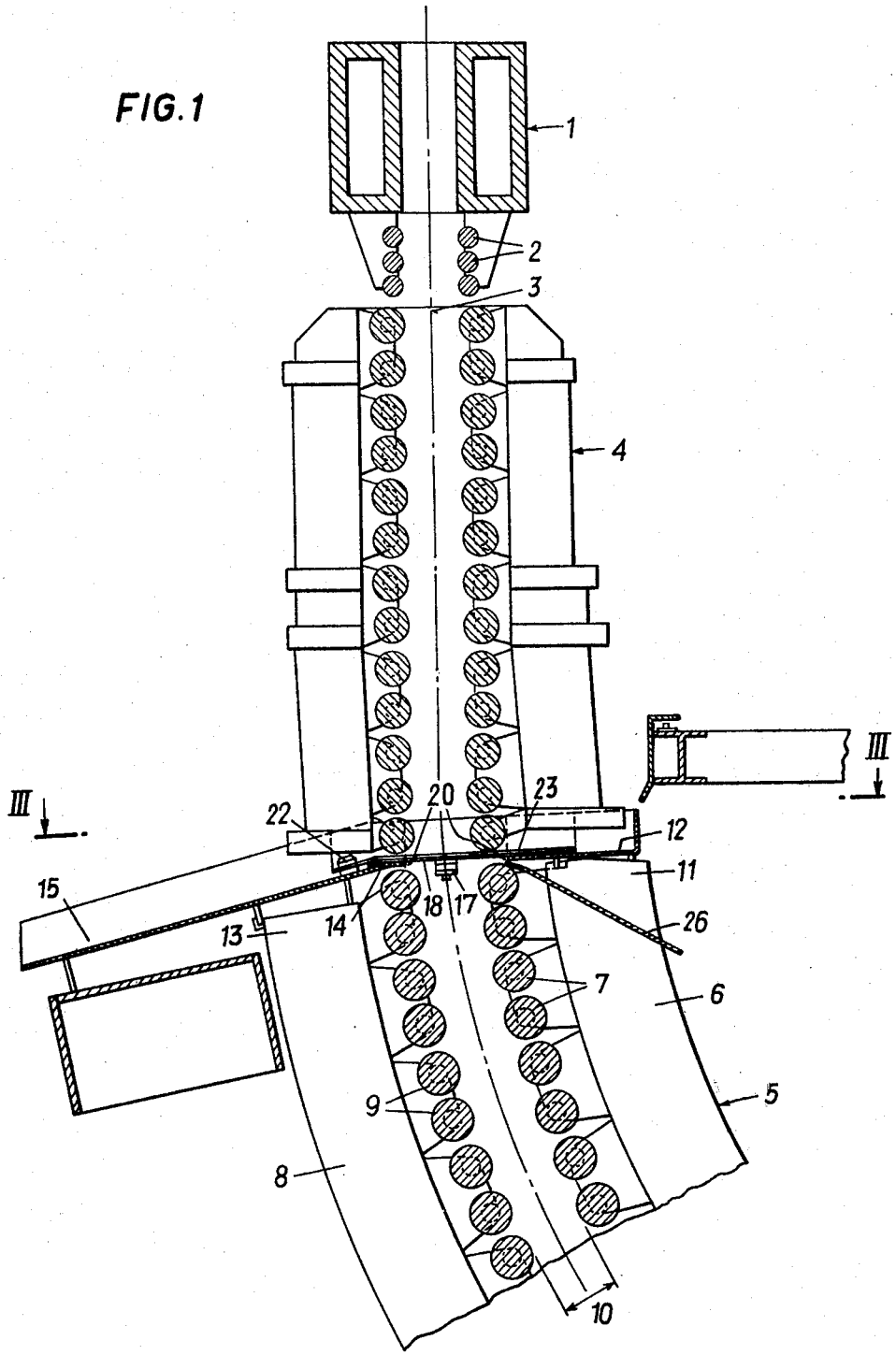
FIGS. 1 and 2 illustrate schematic sectional views through the longitudinal axis of a bow-type continuous casting plant for slabs.

A mould 1 for slabs has a foot roller part 2 mounted at its lower side. In the extraction direction along axis 3 of the strand guide, a bending zone 4 follows the foot roller part 2, in which bending zone the strand is bent according to the radius of the supporting stand 5 following the bending zone 4. The supporting stand 5 comprises longitudinal carriers 6 at the bow inner side, on which bow inner side supporting rollers 7 are mounted, as well as longitudinal carriers 8 at the bow outer side, on which bow outer side supporting rollers 9 are mounted. The bow inner side longitudinal carriers 6 are adjustable relative to the bow outer side longitudinal carriers 8, so that the distance 10 between the rollers 7 and 9 can be adjusted according to the desired slab thickness.

Figure 2:
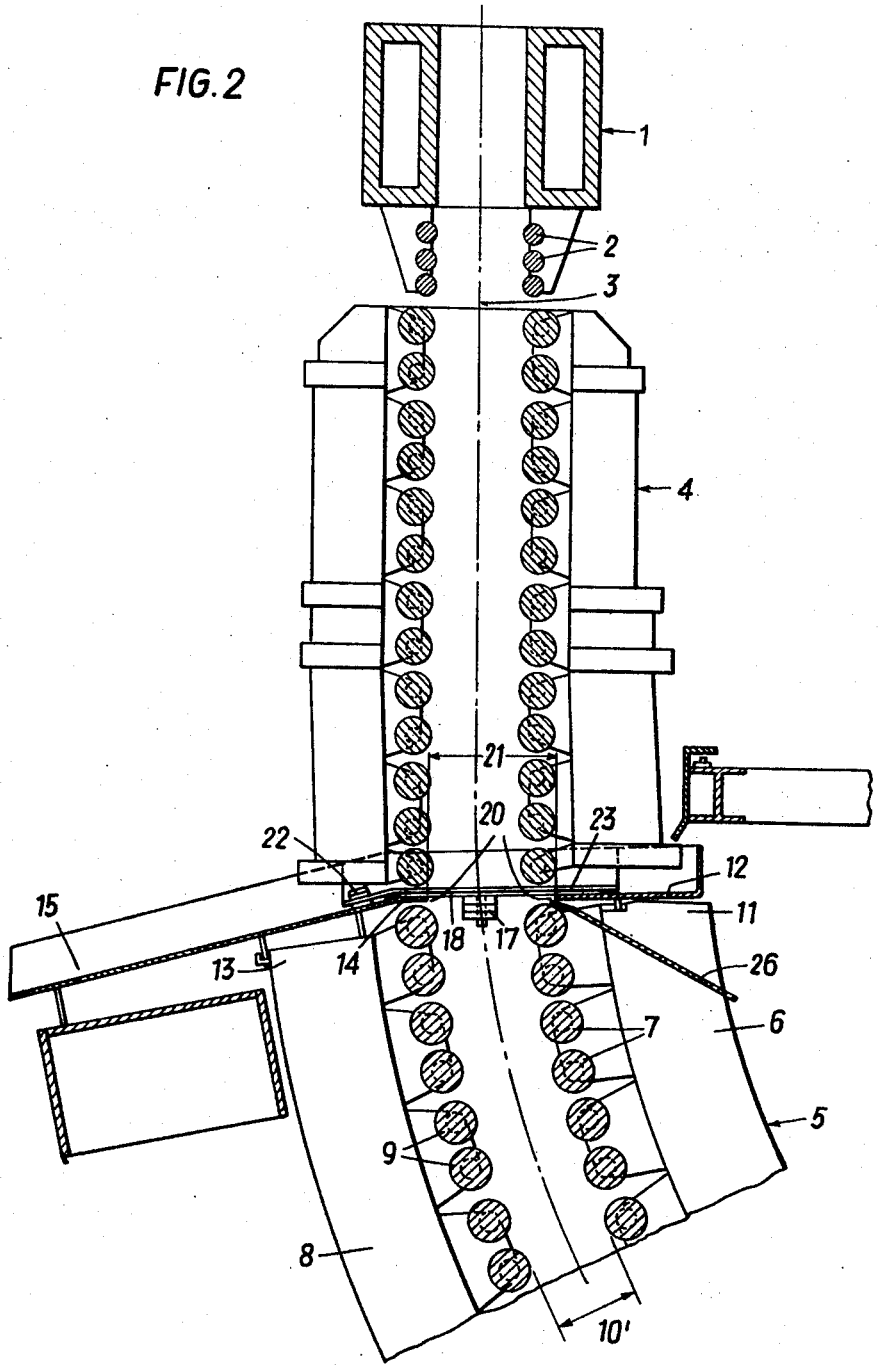

On the upper end 11 of the bow inner side longitudinal carrier 6 a collecting plate 12 is mounted. This plate extends along the slab width. On the opposite side arranged on the outer bow, a collecting plate 14 is also provided on the upper end 13 of the bow outer side longitudinal carriers 8. Plate 14 extends over the total slab width and over part of an obliquely arranged run-off channel 15. If the longitudinal carriers 6, 8 are moved relative to each other in order to adjust the slab thickness 10, the collecting plates mounted at the longitudinal carriers also will carry out these relative movements, the positions of the edges 20 of these collecting plates thus always being at the same distance to the strand surface. FIG. 1 shows the supporting stand with the rollers 7 and 9 adjusted to the smallest distance 10, while FIG. 2 shows the same supporting stand with the rollers 7 and 9 adjusted to the largest distance 10', i.e. adjusted to the greatest possible thickness of a strand to be cast in this plant.

Figure 3:
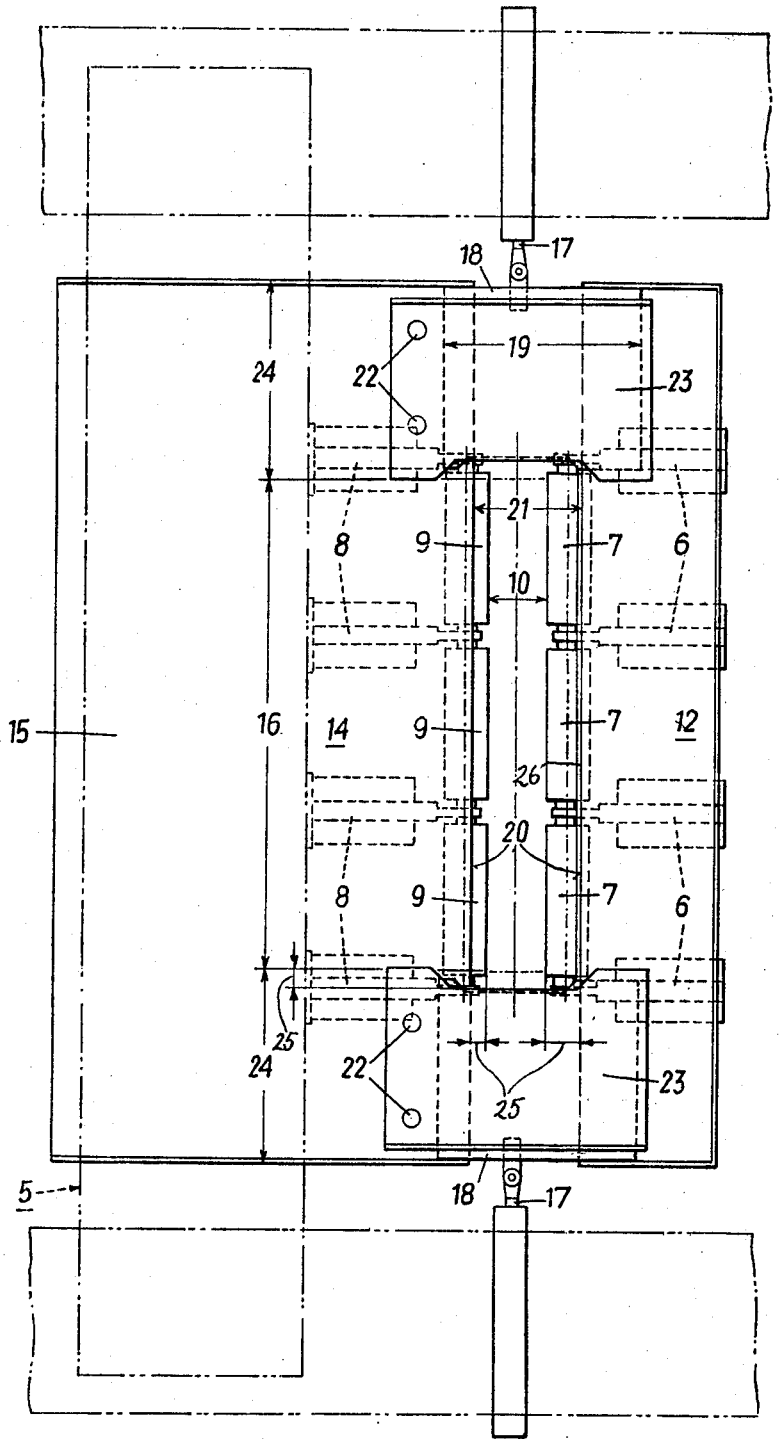
FIGS. 3 and 4 show sections along line III—III of FIG. 1.
Figure 4:
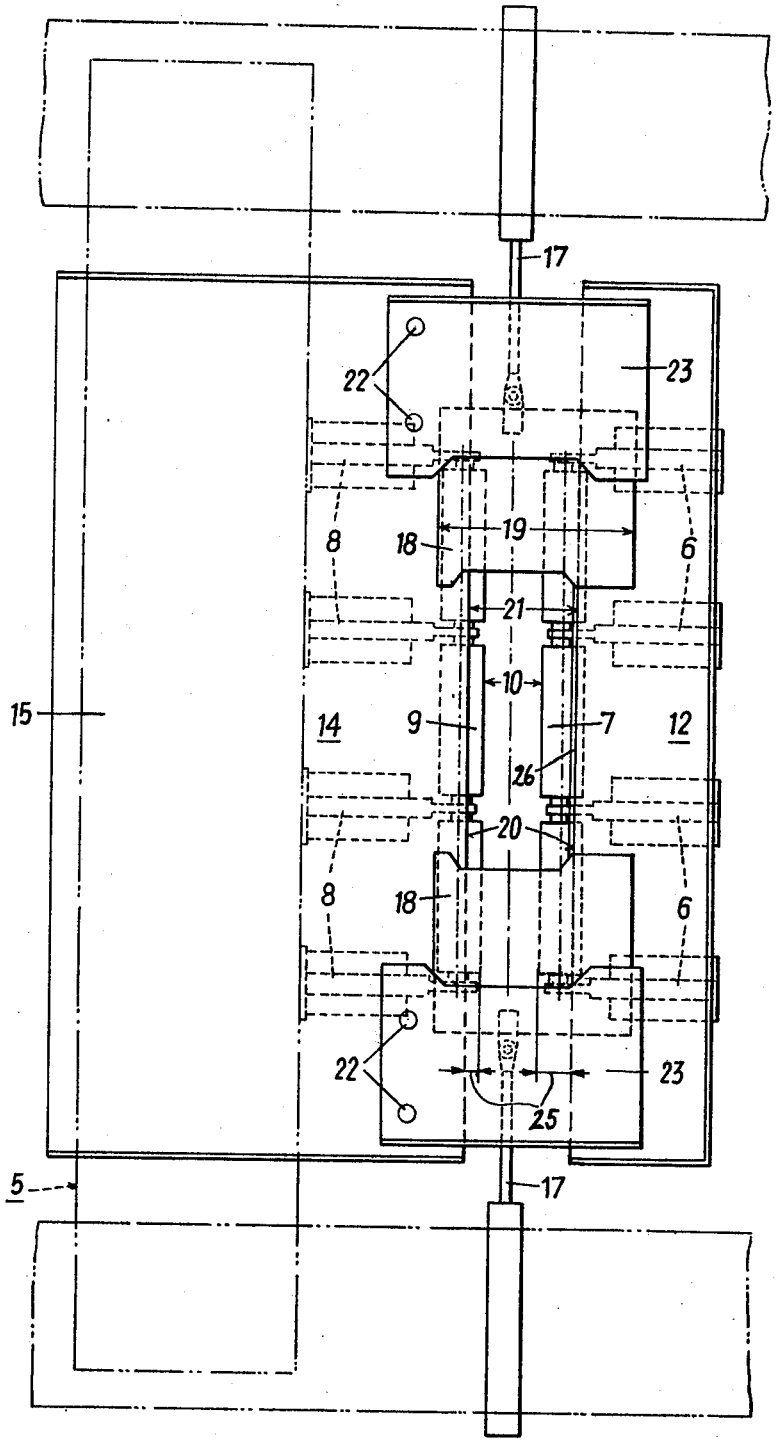

On each of the narrow sides, collecting plates 18 are arranged, which narrow side plates are displaceable in the horizontal direction, for instance by means of a hydraulically actuated tie rod 17 (FIG. 3). The collecting plates 18, in the direction of the narrow side, have a measurement 19 which is greater than the distance 21 between the edges 20 of the collecting plates 12 and 14, which are directed to the slab broad side, when the plant is adjusted for the greatest slab width to be cast, as is illustrated in FIG. 2. At each of the narrow sides a further collecting plate 23 is provided. This plate 23 is fastened on the collecting plate 14 by means of pins 22 and lies over the collecting plates 12 and 14 arranged at the broad sides. The displaceable collecting plates 18 are arranged in height between the level of collecting plates 12 and 14, each arranged at the broad sides, and the level of the collecting plate 23. The two collecting plates 12 and 14 extend beyond the maximum slab width to be cast by this plant, which is denoted by 16 in FIG. 3, by the distance 24. This measure 24 approximately corresponds to the dimension of the collecting plates 23 in the direction of the slab width, so that the protection arrangement, seen from above, always forms a closed collecting surface peripherally enclosing the strand. Illustrated in FIG. 3 is the adjustment of the collecting plates 18 to the largest width of slabs possibly cast in this plant, and in FIG. 4 there is illustrated the adjustment of the collecting plates 18 to the smallest width possible.

Since cooling water is collected by the collecting arrangement, which is always arranged as close as possible to the slab surface during operation of the continuous casting plant, leaving free only a narrow gap 25, a water drainage plate 26 is provided for conducting away the cooling water. Thereby, not only is the overcooling of the strand at one spot prevented, but also oxyhydrogen gas explosions caused by collected cooling water are avoided.

In case of a strand breakthrough, the molten steel is collected by the collecting plates 12, 14, 18 and 23 and conducted out of the region of the supporting stand via the run-off channel 15, so that the supporting stand 5 will not be jeopardized by the molten steel. It is possible to arrange the protection arrangement according to the invention also at other places along the strand guide which are particularly jeopardized, for instance above the bending zone 4.

What we claim is:

1. In a protection arrangement for preventing damage at a plant for continuously casting a strand having the form of a slab with two broad sides and two narrow sides, in case of a breakthrough of molten metal through the solidified skin of the strand, of the type including a mould, a supporting stand for said strand, and a horizontally disposed collecting system for collecting the molten metal, said collecting system being provided below said mould at said supporting stand and enclosing said strand in the peripheral direction, said collecting system including collecting plate means adapted to be displaced and adjusted relative to the strand skin, the improvement which is characterized in that said collecting plate means include two separate first collecting plate units allocated to the two broad sides of the strand, two separate second collecting plate units separate from said first collecting plate units and allocated to the two narrow sides of the strand, said second collecting plate units positioned closely above and overlapping said first collecting plate units, means for separately connecting each of the two first collecting plate units to said supporting stand, and adjusting means for displacing said second collecting plate units relative to said strand.

2. A protection arrangement as set forth in claim 1, wherein each of said second collecting plate units comprises an inner part and an outer part, said inner part being adapted to be retracted and extended relative to said outer part.

3. A protection arrangement as set forth in claims 1 or 2, further comprising a run-off channel connected to one of said collecting plate means.

4. A protection arrangement as set forth in claims 1 or 2, further comprising a run-off channel connected to one of said first collecting plate units.

* * * * *